US009995185B2

(12) United States Patent
Watanabe

(10) Patent No.: US 9,995,185 B2
(45) Date of Patent: Jun. 12, 2018

(54) VALVE TIMING CONTROL DEVICE FOR INTERNAL COMBUSTION ENGINE

(71) Applicant: HITACHI AUTOMOTIVE SYSTEMS, LTD., Hitachinaka-shi, Ibaraki (JP)

(72) Inventor: Kotaro Watanabe, Atsugi (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 102 days.

(21) Appl. No.: 15/023,785

(22) PCT Filed: Sep. 29, 2014

(86) PCT No.: PCT/JP2014/075785

§ 371 (c)(1),
(2) Date: Mar. 22, 2016

(87) PCT Pub. No.: WO2015/050070

PCT Pub. Date: Apr. 9, 2015

(65) Prior Publication Data

US 2016/0230615 A1 Aug. 11, 2016

(30) Foreign Application Priority Data

Oct. 1, 2013 (JP) ..... 2013-206095

(51) Int. Cl.
*F01L 1/34* (2006.01)
*F01L 1/344* (2006.01)
*F01L 1/02* (2006.01)

(52) U.S. Cl.
CPC ..... *F01L 1/34403* (2013.01); *F01L 1/026* (2013.01); *F01L 1/3442* (2013.01); *F01L 2001/34473* (2013.01); *F01L 2101/00* (2013.01); *F01L 2250/06* (2013.01); *F01L 2810/02* (2013.01)

(58) Field of Classification Search
CPC ..... F01L 2001/34453; F01L 1/34403; F01L 1/3442; F01L 2001/34473; F01L 2101/00; F01L 2810/02
USPC ..... 123/90.15, 90.17
See application file for complete search history.

(56) References Cited

U.S. PATENT DOCUMENTS

| | | | | |
|---|---|---|---|---|
| 7,565,889 | B2 * | 7/2009 | Iwata | F01L 1/022 123/90.15 |
| 9,562,447 | B2 | 2/2017 | Sakata et al. | |
| 2002/0056429 | A1 | 5/2002 | Matsuda et al. | |
| 2008/0163838 | A1 | 7/2008 | Iwata et al. | |
| 2016/0024980 | A1 | 1/2016 | Sakata et al. | |

FOREIGN PATENT DOCUMENTS

| | | | |
|---|---|---|---|
| EP | 1 862 695 | A1 | 12/2007 |
| JP | 62-134153 | A | 6/1987 |
| JP | S63-201391 | A | 8/1988 |

(Continued)

*Primary Examiner* — Ching Chang
(74) *Attorney, Agent, or Firm* — Foley & Lardner LLP

(57) ABSTRACT

A valve timing control device 1 has a lock mechanism 30 which limits a relative rotation of a vane rotor 20 with respect to a housing 10 by engaging a lock plate 31 that is accommodated slidably in a radial direction with an engagement groove 32 of the vane rotor 20 by biasing force of a spring 33 in the housing 10. The lock plate 31 is provided with a plurality of penetrating holes 35 which are opened on a circumferential direction side surface of the lock plate 31.

18 Claims, 11 Drawing Sheets

(56) References Cited

FOREIGN PATENT DOCUMENTS

| | | | |
|---|---|---|---|
| JP | 2577004 | B2 | 1/1997 |
| JP | 2001-227307 | A | 8/2001 |
| JP | 2002-213213 | A | 7/2002 |
| JP | 2004-116410 | A | 4/2004 |
| JP | 3533688 | B2 | 5/2004 |
| JP | 2006-177212 | A | 7/2006 |
| JP | 2006-226400 | A | 8/2006 |
| JP | 2006-249970 | A | 9/2006 |
| JP | 2016-031035 | A | 3/2016 |

* cited by examiner

VALVE TIMING CONTROL DEVICE FOR INTERNAL COMBUSTION ENGINE

TECHNICAL FIELD

The present invention relates to a valve timing control device for an internal combustion engine which controls open and closing timing of an intake valve and/or an exhaust valve of the internal combustion engine depending on an operating condition.

BACKGROUND TECHNOLOGY

As a related art valve timing control device, for example, there has been known a valve timing control device disclosed in the following Patent Document 1.

That is, the valve timing control device changes open and closing timing of an engine valve by the fact that a vane rotor that rotates in synchronization with a camshaft rotates relative to a housing that rotates in synchronization with a crankshaft then a rotation phase of the camshaft with respect to the crankshaft is changed.

The valve timing control device has a lock mechanism serving to hold a phase of the vane rotor at the time of an engine stop and secure subsequent engine startability. The lock mechanism mainly has a lock plate provided movably in a radial direction in the housing and limiting a relative rotation of the vane rotor with respect to the housing by engaging with an engagement groove that is recessed in an outer periphery of a base part of the vane rotor, and a spring interposed between the lock plate and the housing and forcing the lock plate to the base part side (center side) of the vane rotor.

PRIOR ART REFERENCE

Patent Document

Patent Document 1: Japanese Patent Application Publication 2004-116410

SUMMARY OF THE INVENTION

Task to be Solved by the Invention

In a case of the related art valve timing control device, however, since the lock mechanism has a structure in which the lock plate is forced to a radially inner side of the base part, centrifugal force acts on the lock plate with a rotation of the device. Therefore, it is necessary for the spring to secure at least a biasing force that overcomes the centrifugal force.

However, if the biasing force of the spring is made stronger, release oil pressure, which overcomes the biasing force, is required to release a locked state. Therefore, problems, such as deterioration of fuel economy, occur.

The present invention was made in consideration of such a case of the related art valve timing control device. An object of the present invention is to provide a valve timing control device for an internal combustion engine which is capable of reducing influence of the centrifugal force and reducing the biasing force required of a biasing member.

Means for Solving the Task

The valve timing control device for the internal combustion engine of the present invention has: a driving rotation body to which rotation force is transmitted from a crankshaft; a driven rotation body accommodated in the driving rotation body and rotatably provided relative to the driving rotation body within a predetermined angle range; a lock member having a plate shape and provided so as to move forward and backward along a radial direction from one side of the driving rotation body and the driven rotation body to the other side of the driving rotation body and the driven rotation body, the lock member provided, at a part thereof, with a lightening portion; an engagement groove with which a tip end side of the lock member is engaged when a relative phase of the driven rotation body with respect to the driving rotation body becomes a predetermined phase; a biasing member which biases the lock member to an engagement groove side; and a release unit which releases engagement of the lock member to the engagement groove by supplying oil pressure to a pressure-receiving portion provided at the tip end side of the lock member.

In addition, as another mode of the lock member, it is possible to form the lock member by polymerizing different materials, or by hollowing an inside of the lock member.

Effects of the Invention

According to the present invention, since the weight of the lock member can be reduced, influence caused by the centrifugal force acting during the rotation of the device is reduced. It is therefore possible to reduce the biasing force required of the biasing member. With this, the oil pressure required to release the lock can be reduced, thereby improving fuel economy, etc.

BRIEF DESCRIPTION OF THE DRAWINGS

FIG. 5 (*a*) is a perspective view, FIG. 5 (*b*) is a side view, and FIG. 5 (*c*) is a sectional view taken along a line A-A of FIG. 5 (*b*).

FIG. 6 (*a*) is a perspective view, FIG. 6 (*b*) is a side view, and FIG. 6 (*c*) is a sectional view taken along a line B-B of FIG. 6 (*b*).

FIG. 7 (*a*) is a perspective view, FIG. 7 (*b*) is a side view, and FIG. 7 (*c*) is a sectional view taken along a line C-C of FIG. 7 (*b*).

FIG. 8 (*a*) is a perspective view, FIG. 8 (*b*) is a side view, and FIG. 8 (*c*) is a sectional view taken along a line D-D of FIG. 8 (*b*).

FIG. 9 (*a*) is a perspective view, FIG. 9 (*b*) is a side view, and FIG. 9 (*c*) is a sectional view taken along a line E-E of FIG. 9 (*b*).

FIG. 10 (*a*) is a perspective view, FIG. 10 (*b*) is a side view, and FIG. 10 (*c*) is a sectional view taken along a line F-F of FIG. 10 (*b*).

FIG. 11 (*a*) is a perspective view, FIG. 11 (*b*) is a side view, and FIG. 11 (*c*) is a sectional view taken along a line G-G of FIG. 11 (*b*).

MODE FOR IMPLEMENTING THE INVENTION

Figure 1:
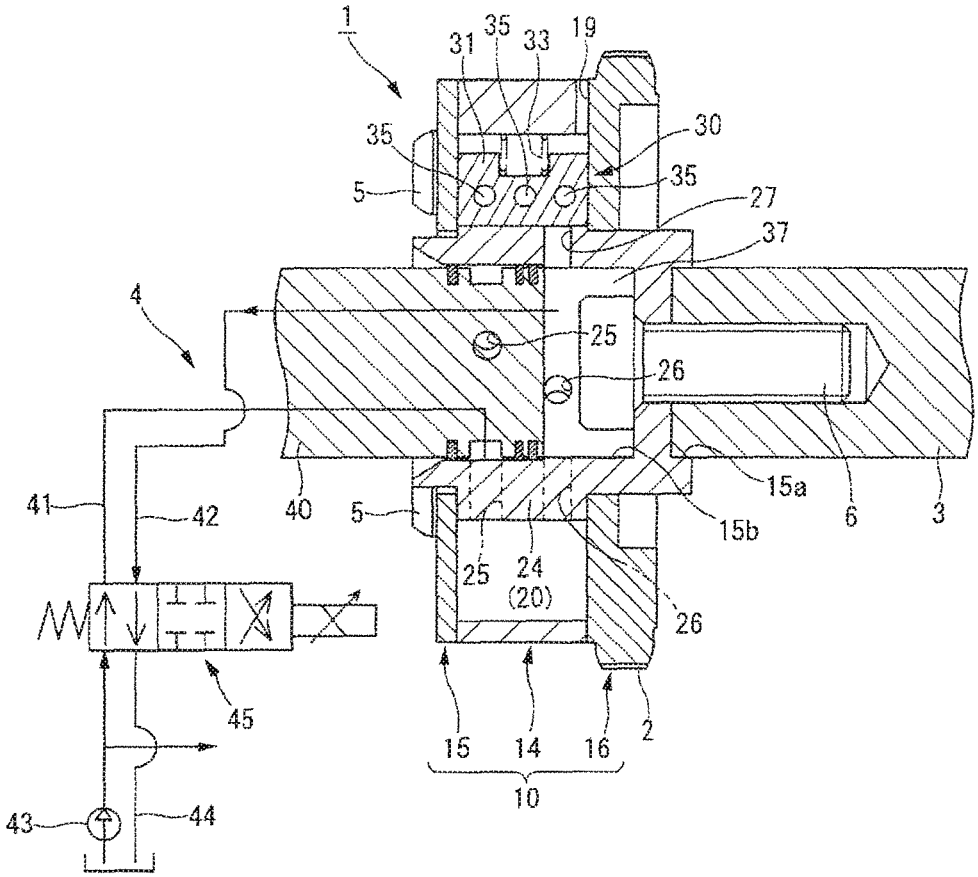
FIG. 1 shows a longitudinal sectional view of the present device showing a locked state of a valve timing control device according to the present invention.

In the following, embodiments of a valve timing control device for an internal combustion engine according to the present invention will be explained based on the drawings. Each of the following embodiments shows a case where the present device is applied to a valve device of an intake side.

[First Embodiment]

FIG. 1 to FIG. 5 show a first embodiment of a valve timing control device for an internal combustion engine according to the present invention. The valve timing control device 1 is interposed between a sprocket 2 which is rotatably driven by rotation force of a crankshaft (not shown) and a camshaft 3 rotatably provided relative to the sprocket 2. The valve timing control device 1 changes a relative rotation phase between both of 2 and 3 by operation control through a predetermined oil pressure supply-exhaust unit 4.

Specifically, the valve timing control device 1 mainly has a substantially cylindrical housing 10, which is a driving rotation body, positioned at an outer peripheral side of one end portion of the camshaft 3 and having, in an inner peripheral side of the housing 10, a plurality of shoes 11 to 13 (in the present embodiment, three shoes) that project from the inner peripheral side of the housing 10, and a vane rotor 20, which is a driven rotation body, relatively rotatably accommodated in an inner peripheral side of the housing 10 and having a plurality of vanes 21 to 23, which correspond to the shoes 11 to 13 respectively, projecting from an outer peripheral portion of a cylindrical rotor body 24 which is fixed to one end portion of the camshaft 3. The valve timing control device 1 is operated and controlled by selectively supplying oil pressure from the oil pressure supply-exhaust unit 4 to a retard angle chamber Re and an advance angle chamber Ad that are a pair of oil pressure chambers isolated between the shoes 11 to 13 and the vanes 21 to 23.

The housing 10 has a substantially cylindrical housing body 14 in which each of the shoes 11 to 13, which is in sliding-contact with the rotor body 24 of the vane rotor 20, projects in the inner peripheral side of the housing 10, and a front plate 15 and a rear plate 16 serving as the sprocket 2 which close front and rear opening ends of the housing body 14. The front plate 15 and the rear plate 16 are tightened together with four bolts 5 so as to sandwich the housing body 14.

The vane rotor 20 has a structure which is capable of integrally rotating with the camshaft 3 by being fit onto one end portion of the camshaft 3 through a first fitting portion 15*a* recessed in a rear end side (a side facing to the camshaft 3) of the rotor body 24 and being fastened to the camshaft 3 with a cam bolt 6 which is inserted into a second fitting portion 15*b* that penetrates a center portion of the rotor body 24.

By the above structure, a rotation phase of the camshaft 3 with respect to the crankshaft (not shown) is changed by rotating the vane rotor 20 rotating in synchronization with the camshaft 3, relative to the housing 10 rotating in synchronization with the crankshaft (not shown). With this change of the rotation phase, the open and closing timing of the intake valve (not shown) is changed.

Here, in the rotor body 24, a plurality of retard angle side communication ports 25, which connect an after-mentioned retard angle side oil passage 41 and each of the retard angle chambers Re, penetrate through predetermined positions along a radial direction in a circumferential direction of a front end side (an opposite side to the camshaft 3) of the rotor body 24. By these retard angle side communication ports 25, supply and exhaust of operating oil pressure to each of the retard angle chambers Re are performed. Likewise, a plurality of advance angle side communication ports 26, which connect an after-mentioned relay chamber 37 and each of the advance angle chambers Ad, penetrate through predetermined positions along the radial direction in the circumferential direction in a rear end side of the rotor body 24. By these advance angle side communication ports 26, the supply and the exhaust of the operating oil pressure to each of the advance angle chambers Ad are performed.

Further, a lock mechanism 30 serving for phase holding of the vane rotor 20 at the time of engine stop is provided between the housing 10 and the vane roto 20 i.e. between the housing body 14 and the rotor body 24 in the radial direction. The lock mechanism mainly has a lock plate 31, which is a lock member having a plate shape, interposed between the housing body 14 and the rotor body 24 so as to be able to move in the radial direction and limiting the relative rotation of the vane rotor 20 with respect to the housing 10 by engaging with an engagement groove 32 recessed in an outer peripheral portion of the rotor body 24, a spring 33, which is a biasing member, interposed between the lock plate 31 and the housing body 14 and constantly forcing the lock plate 31 toward the rotor body 24, and a release unit 34 which releases the engagement of the lock plate 31 to the engagement groove 32 by actuating the oil pressure to one end side that is a tip end side of the lock plate 31.

The lock plate 31 is made of an iron based metal material and formed into a rectangular plate shape. The lock plate 31 is accommodated in a first accommodating portion 17 formed by being cut out along the radial direction from a tip end side of a widest shoe 11 in the housing body 14, and is guided by an inner side surface 17*a* of the first accommodating portion 17 so as to move in the radial direction. In addition, a plurality of substantially circular penetrating holes 35 as a lightening portion (in the present embodiment, three penetrating holes) penetrates, along a plate thickness direction of the lock plate 31, through a side surface 31*a* (hereinafter called "circumferential direction side surface") corresponding to a rotation direction (circumferential direction) of the device (see FIG. 5).

The spring 33 is accommodated in a second accommodating portion 18 which is enlarged and formed at a bottom portion side of the first accommodating portion 17. One end side of the spring 33 is seated on a bottom portion 18*a* of the second accommodating portion 18, and the other side is seated on a spring seating portion 36 recessed in the other end portion of the lock plate 31, then the spring 33 is interposed between the housing body 14 and the lock plate 31. Further, a breathing port 19 which connects the second accommodating portion 18 and an external portion penetrates through the bottom portion 18*a* of the second accommodating portion 18. With this breathing port 19, fluctuation of the volume of the second accommodating portion 18 caused by the radial direction movement of the lock plate 31 is absorbed.

The release unit 34 mainly has the oil pressure supply-exhaust unit 4, a relay chamber 37 defined between an after-mentioned passage component portion 40 and the second fitting portion 15*b* and serving to supply and exhaust the oil pressure actuated by the oil pressure supply-exhaust unit 4 and a releasing communication port 27 penetrating, along the radial direction, through an axial direction position that is the same direction as that of each advance angle side communication port 26 and connecting the relay chamber 37 and the engagement groove 32. Furthermore, the release unit 34 exerts the oil pressure introduced in the relay chamber 37 through the oil pressure supply-exhaust unit 4 (through each advance angle side oil passage 42) to the one end of the lock plate 31 through the releasing communication port 27.

Figure 3:
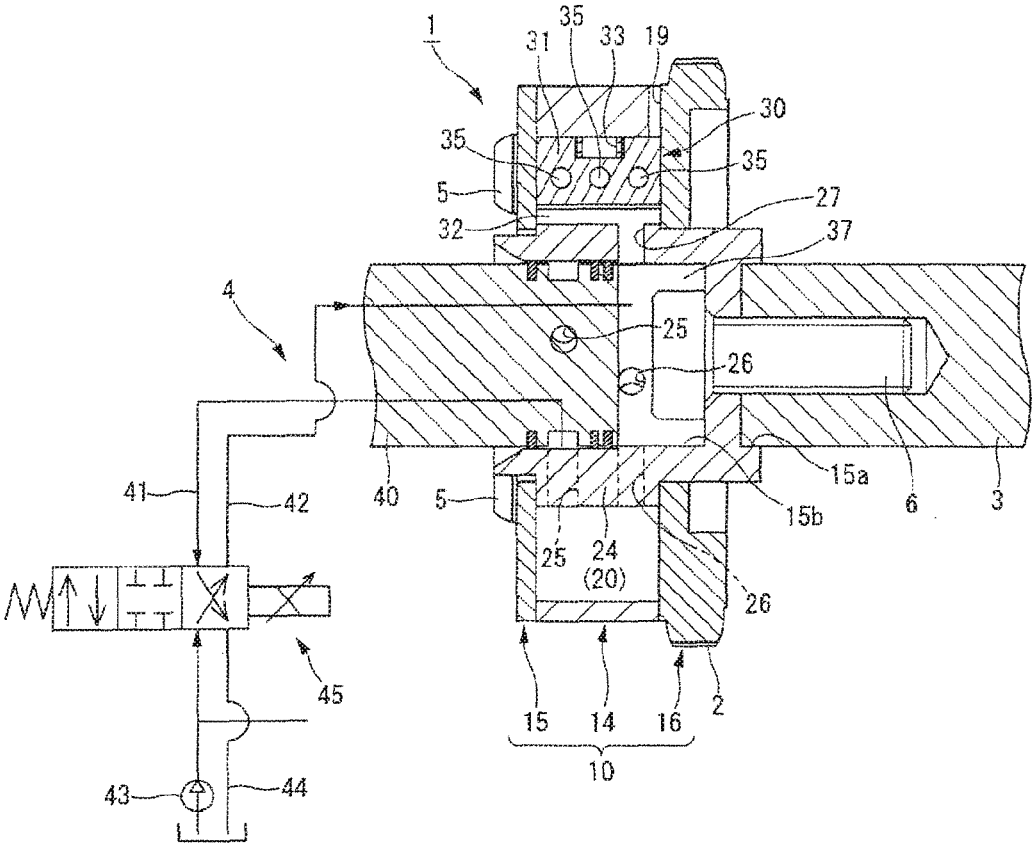
FIG. 3 is a longitudinal sectional view of the present device showing a lock-released state of the valve timing control device according to the present invention.

As shown in FIG. 1 and FIG. 3, the oil pressure supply-exhaust unit 4 selectively supplies the oil pressure to each of the oil pressure chambers Ad and Re or selectively exhausts operating oil supplied in each of the oil pressure chambers Ad and Re. The oil pressure supply-exhaust unit 4 mainly has the passage component portion 40 that is fitted and inserted into the second fitting portion 15*b* recessed in the front end side of the rotor body 24 and forms, inside the passage component portion 40, the retard angle side oil passage 41 connecting to the retard angle side communication port 25 and the advance angle side oil passage 42 connecting to the advance angle side communication port 26, an oil pump 43 which supplies the oil pressure to one side of the oil passages 41 or 42 through an electromagnetic valve 45, and a drain passage 44 which is connected with the other side of the oil passages 41 or 42, which is not connected with the oil pump 43 through the electromagnetic valve 45.

Further, the electromagnetic valve 45 is a well-known two directions switching valve. The electromagnetic valve 45 selectively switches and controls connections between the retard angle side oil passage 41 and the advance angle side oil passage 42 and the oil pump 43 and the drain passage 44 based on a control signal from an electronic control unit (ECU) (not shown).

In the following, working effects of the valve timing control device 1 for the internal combustion engine according to the present embodiment will be explained based on FIG. 1 to FIG. 4.

Figure 2:
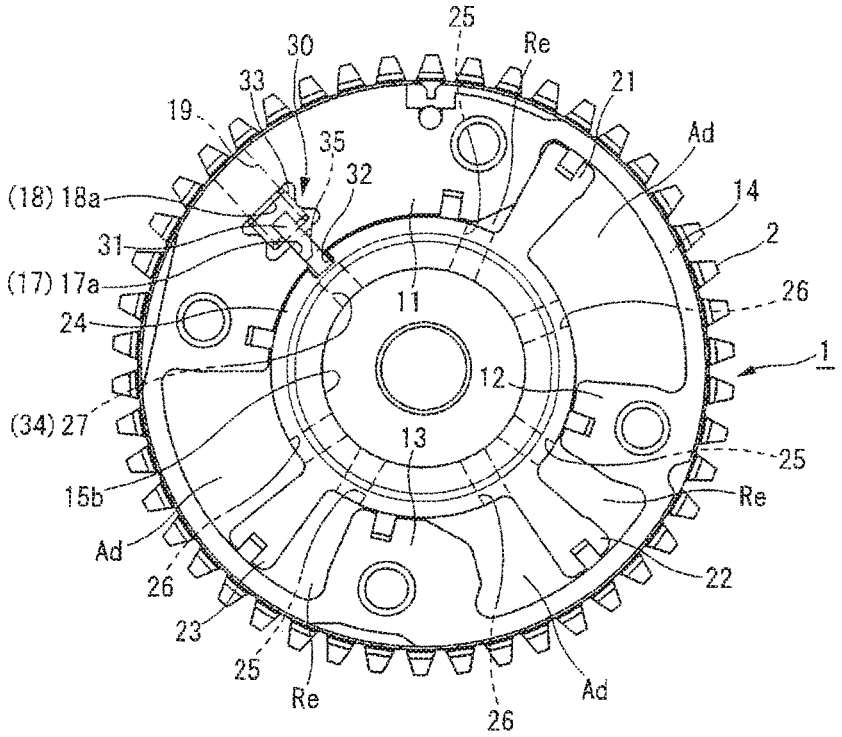
FIG. 2 is a front view showing a state in which a front cover is removed in the valve timing control device shown in FIG. 1.

First, in a low rotation region from engine start, as shown in FIG. 1 and FIG. 2, the retard angle side oil passage 41 is connected with the oil pump 43 and the advance angle side oil passage 42 is connected with the drain passage 44. With this connection, the relative rotation phase of the camshaft 3 with respect to the crankshaft (not shown) is held at a most retarded position with the lock plate 31 engaged with the engagement groove 32 without exertion of the oil pressure to one end side of the lock plate 31.

In this locked state, centrifugal force acts on the lock plate 31 by a rotation of the crankshaft (not shown). However, in a case of the lock plate 31 according to the present embodiment, by providing each of the penetrating holes 35, the weight of the lock plate 31 is reduced. Therefore, as compared with a conventional case where a solid lock plate is used, influence of the centrifugal force can be reduced. As a result, biasing force of the spring 33 against the centrifugal force can be reduced.

Figure 4:
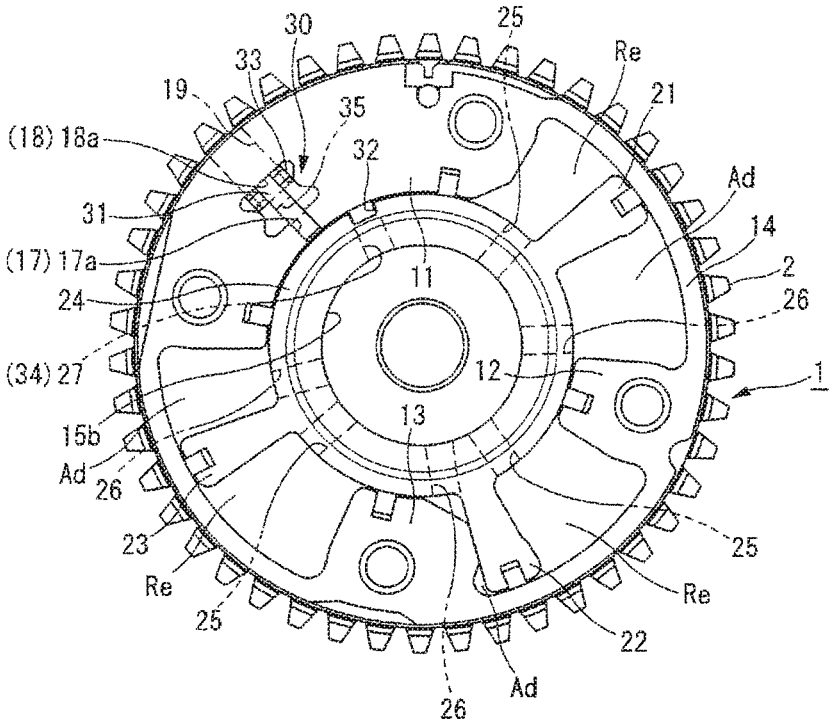
FIG. 4 is a front view showing a state in which a front cover is removed in the valve timing control device shown in FIG. 3.
Figure 5:
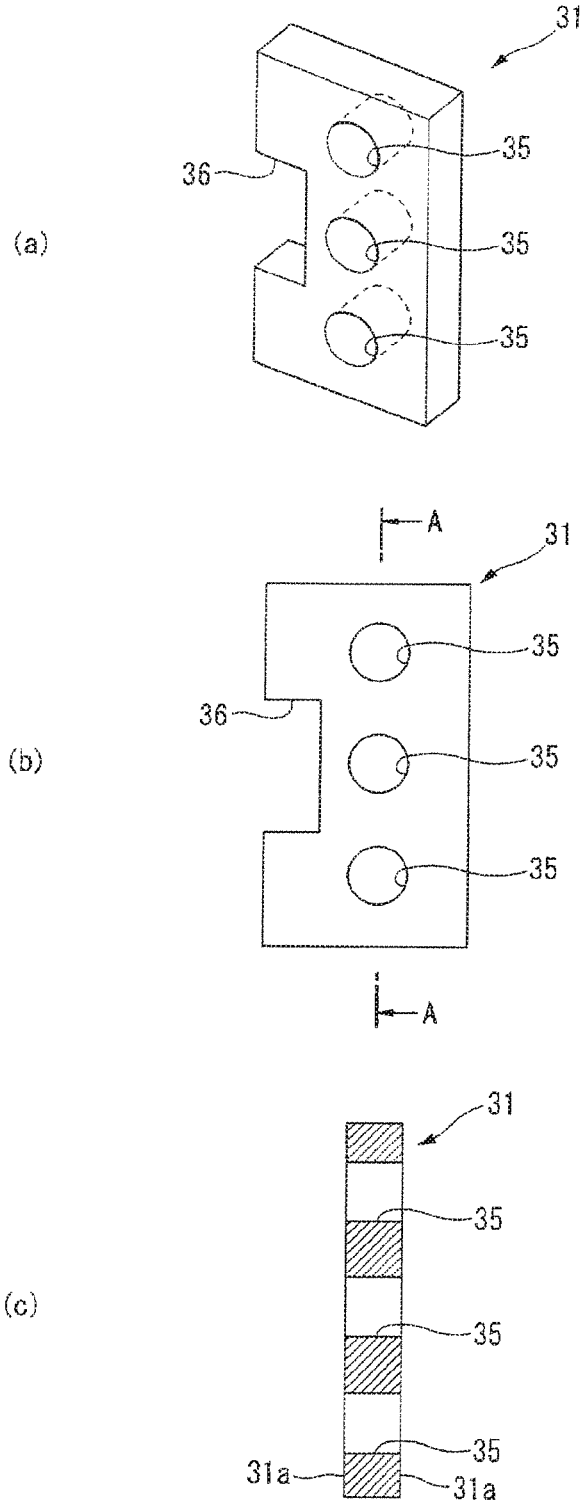
FIG. 5 (*a*) to FIG. 5 (*c*) show a lock member according to a first embodiment of the present invention.

On the other hand, when operating condition of the engine is shifted to a load region that is a middle rotation region or more, as shown in FIG. 3 and FIG. 4, the advance angle side oil passage 42 is connected with the oil pump 43 and the retard angle side oil passage 41 is connected with the drain passage 44. With this connection, the oil pressure acts on the one end side of the lock plate 31, then the one end portion of the lock plate 31 is released from the engagement groove 32. As a result, the vane rotor 20 is turned in a clockwise direction with an oil pressure supply to the advance angle chamber Ad, and the relative rotation phase of the camshaft 3 with respect to the crankshaft is changed in an advancement direction.

Here, in the valve timing control device 1 according to the present embodiment, when the lock is released, since the biasing force of the spring 33 can be reduced by the weight reduction of the lock plate 31 as mentioned above, the oil pressure required to release the lock can be reduce. As a result, driving force of the oil pump 43 can be reduced, thus, fuel economy of the engine is improved.

Furthermore, in a case of the lock pate 31, since the circumferential direction side surface 31*a* of the lock pate 31 is provided with the penetrating hole 35, operating oil leaking out from the one end side through a minute gap between the circumferential direction side surface 31*a* of the lock plate 31 and the inner side surface 17*a* of the first accommodating portion 17 is stored in each of the penetrating holes 35. With this storage, the operating oil is used for lubrication against friction between the lock plate 31 and the housing body 14 (the inner side surface 17*a* of the first accommodating portion 17) at the time of sliding of the lock plate 31. Thus, it becomes possible to suppress the friction caused by galling, etc. of the lock plate 31. As a result, it is also possible to secure a good operation of the lock mechanism 30.

As explained above, in the valve timing control device 1 according to the present embodiment, by providing the penetrating holes 35, the weight of the lock plate 31 can be reduced. As a result, the influence of the centrifugal force which acts at the time of the rotation of the device is reduced, thereby reducing the biasing force required of the spring 33. With this, releasing oil pressure of the lock mechanism 30 can be reduced and fuel economy is improved.

Moreover, in a case of the present embodiment, each of the penetrating holes 35 is opened on the circumferential direction side surface 31*a* of the lock plate 31. Therefore, a part of the operating oil for the releasing oil pressure is stored in each of the penetrating holes 35, then the lubrication of sliding of the lock plate 31 can be improved by the stored operating oil. As a result, occurrence of partial abrasion, etc. of the lock plate 31 is suppressed, and durability of the device can be also improved.

In addition, a plurality of penetrating holes 35 (three penetrating holes) are provided. Therefore, as compared with a case where the penetrating hole 35 is formed as a single hole, an entire volume of the penetrating hole 35 can be larger. Thus, further weight reduction of the lock plate 31 can be possible, which results in improvement in fuel economy, and more operating oil is stored, which results in improvement in lubricity.

Figure 6:
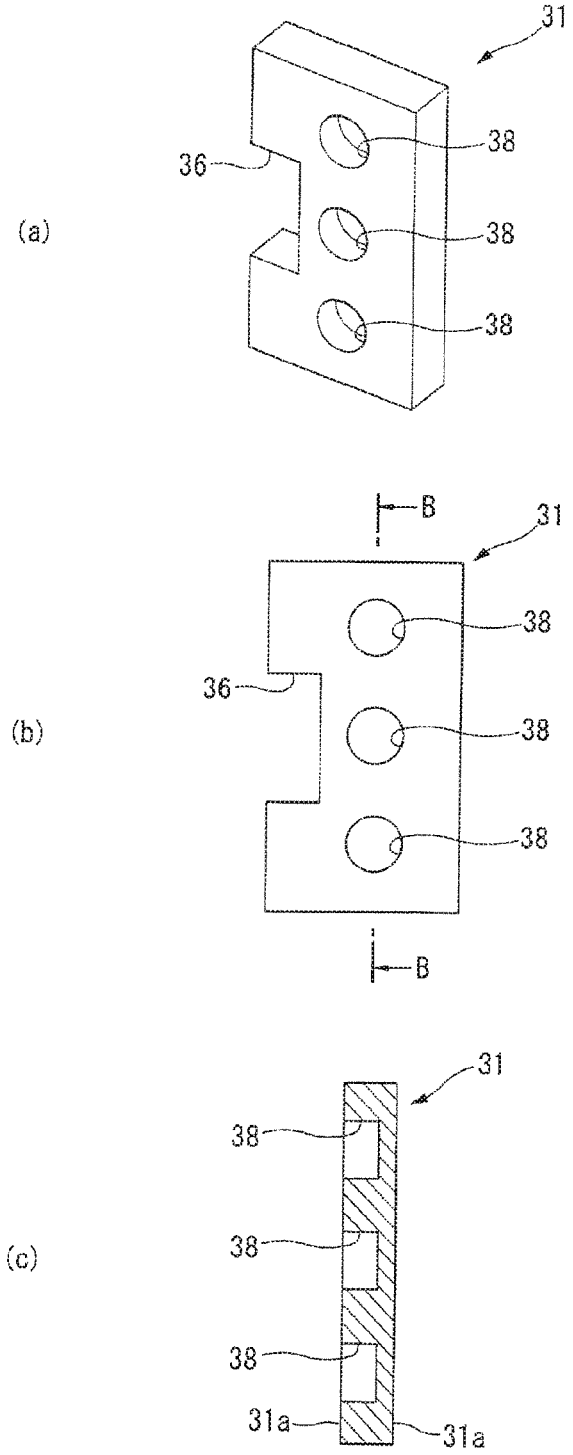
FIG. 6 (*a*) to FIG. 6 (*c*) show another modification example of the lock member according to the first embodiment of the present invention.
Figure 7:
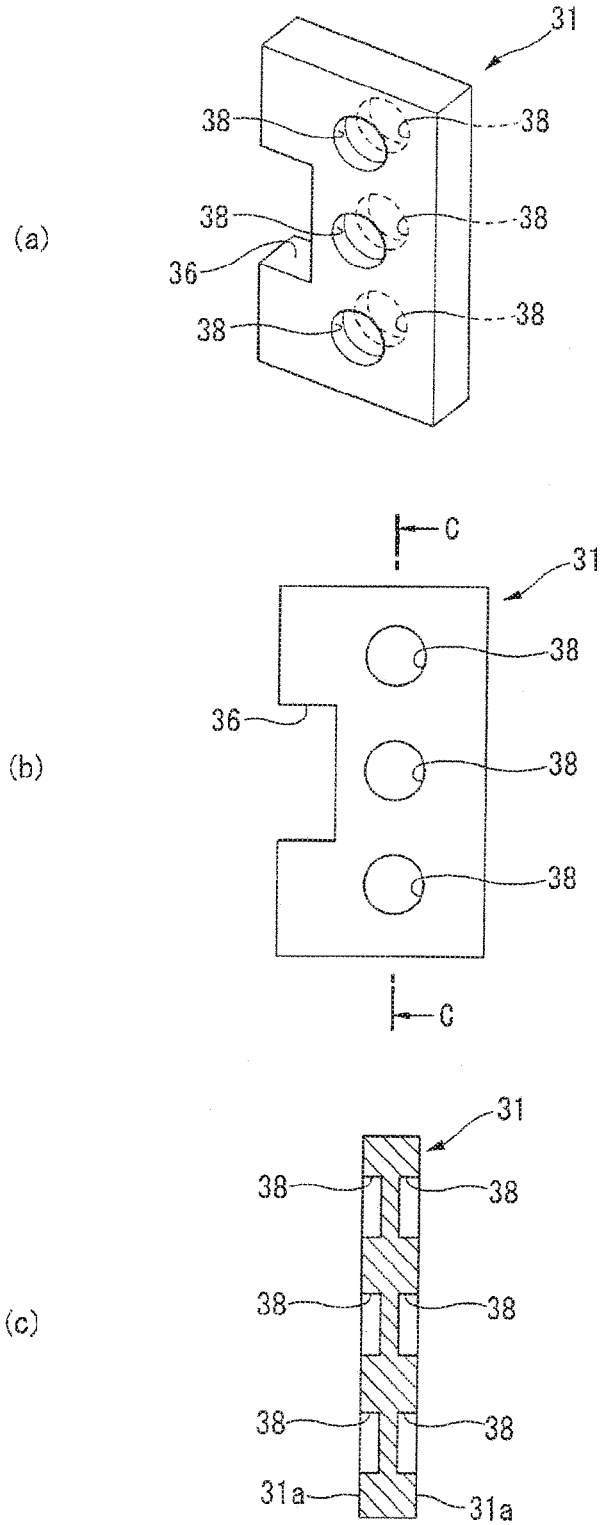
FIG. 7 (*a*) to FIG. 7 (*c*) show another modification example of the lock member according to the first embodiment of the present invention.

Although the present embodiment shows a case where the lightening portion of the lock plate 31 is formed by the penetrating hole 35, as a mode of the lightening portion, besides the penetrating hole 35, it could be formed by providing a concave portion 38 shown in FIG. 6 and FIG. 7. In addition, regarding shapes of the above penetrating hole 35 and the above concave portion 38, they are not limited to the circle, but are, for example, a polygon.

[Second Embodiment]

Figure 8:
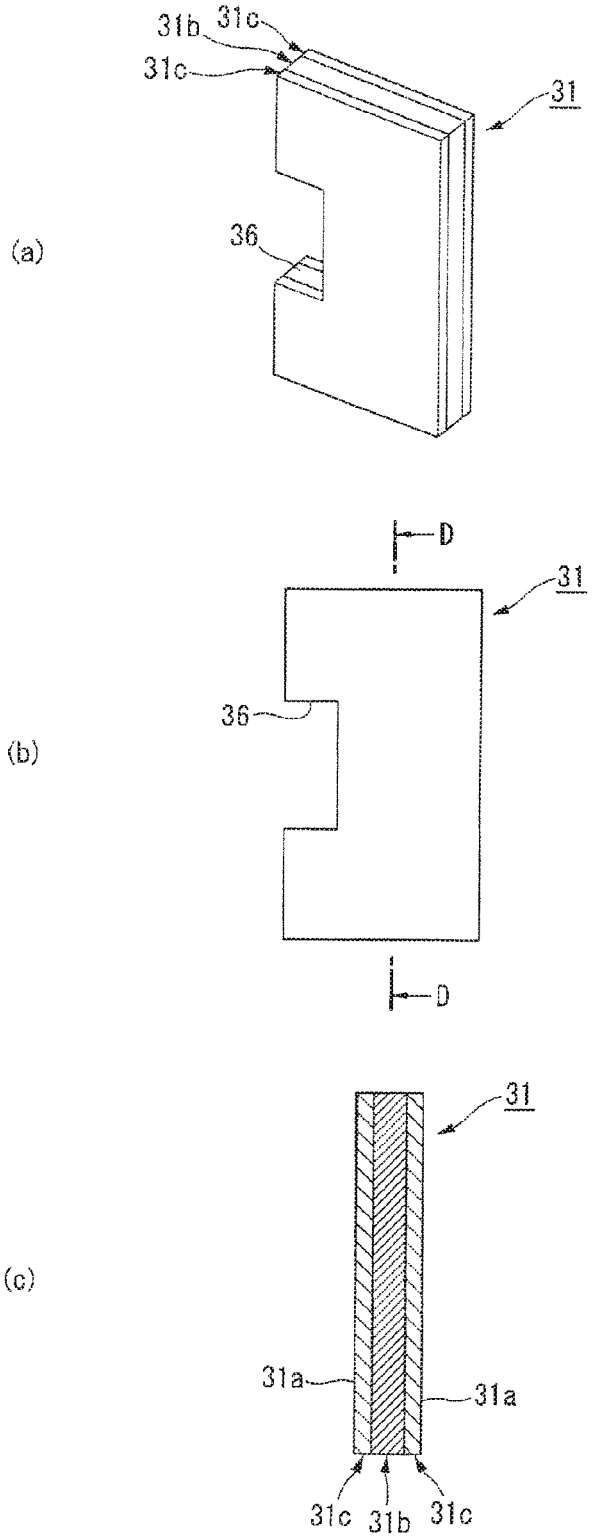
FIG. 8 (*a*) to FIG. 8 (*c*) show a lock member according to a second embodiment of the present invention.

FIG. 8 shows a second embodiment of the valve timing control device for the internal combustion engine according to the present invention, in which a structure of the lock plate 31 according to the first embodiment is changed.

That is, in the present embodiment, the lock plate 31 is formed by polymerizing metal materials which are different from each other. A lock plate body 31*b* of the lock plate 31 which becomes a core is made of an aluminum based metal material, and each of sliding contact portions 31*c*, 31*c*, which are circumferential direction both side portions of the lock plate body 31*b*, is made of an iron based metal material.

In this manner, regarding the lock plate body 31*b* forming the core, it is made of the aluminum based metal material having a low specific gravity, therefore the weight of the lock plate 31 can be reduced. As to the sliding contact portions 31*c*, 31*c* which are in sliding-contact with the housing body 14, they are made of the iron based metal material having a relatively high hardness, thus abrasion resistant can be obtained. As a result, also in the present embodiment, fuel economy can be improved by the weight reduction of the lock plate 31, and durability of the device can be improved by securing the abrasion resistant of the lock plate 31.

In other words, in a case of a single material, in general, if weight reduction is prioritized, abrasion resistant becomes low, and if improvement of the abrasion resistant is prioritized, the weight reduction is sacrificed. Thus, physical properties of the lock plate 31 are limited. However, by employing a multilayer structure using different materials like the present embodiment, the both contrary properties, such as the weight reduction and the abrasion resistant, can be achieved.

Figure 9:
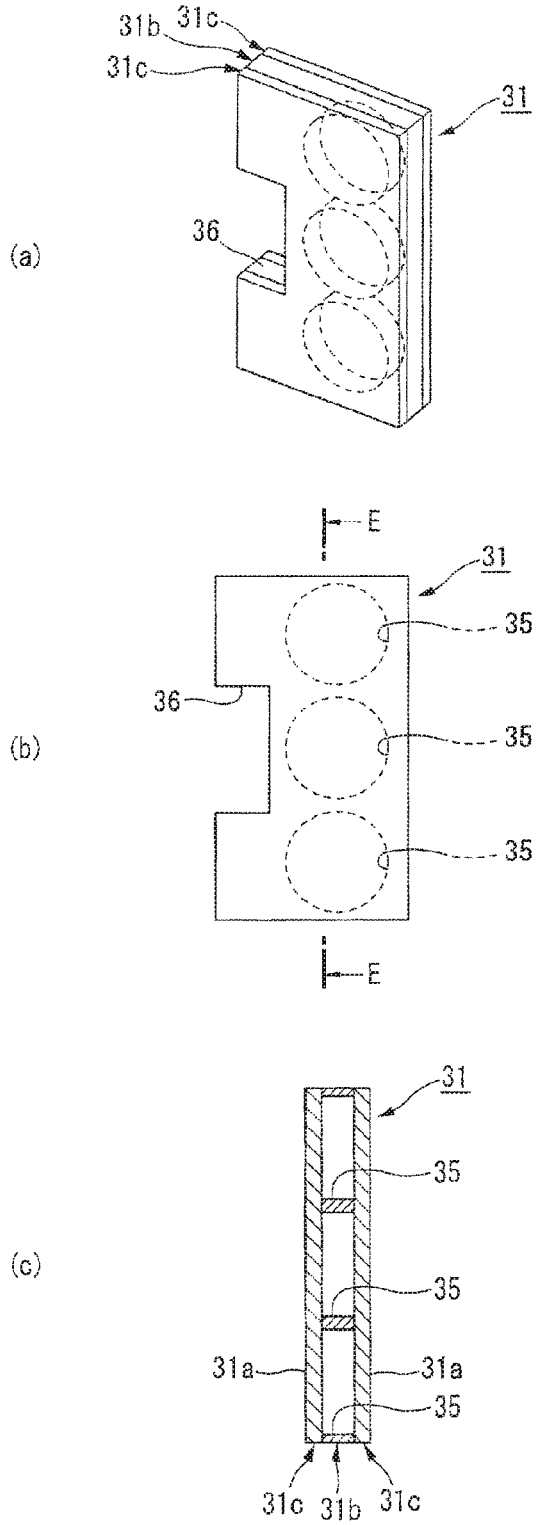
FIG. 9 (*a*) to FIG. 9 (*c*) show another modification example of the lock member according to the second embodiment of the present invention.

Here, also in the present embodiment, as shown in FIG. 9, the penetrating holes 35 as the lightening portion according to the first embodiment may be provided at the lock plate body 31*b*. By the above structure, further weight reduction of the lock plate body 31*b* can be improved, thereby further improving fuel economy.

[Third Embodiment]

Figure 10:
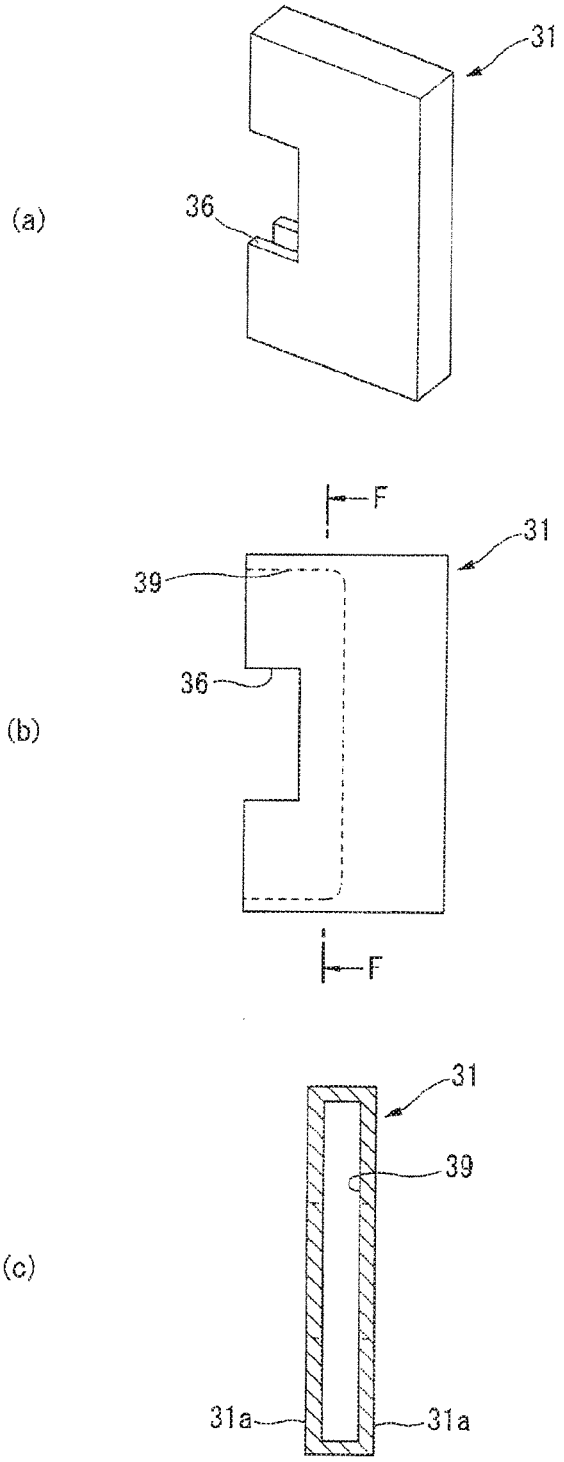
FIG. 10 (*a*) to FIG. 10 (*c*) show a lock member according to a third embodiment of the present invention.

FIG. 10 shows a third embodiment of the valve timing control device for the internal combustion engine according to the present invention, in which the structure of the lock plate 31 according to the first embodiment is changed.

That is, in the present embodiment, the lock plate 31 has a structure in which a hollow portion 39 as the lightening portion is provided at the other end side of the lock plate 31. An area of the hollow portion 39 can be arbitrarily changed depending on a specification of the device, and, as shown in FIG. 11, the whole of the lock plate 31 may be formed into a hollow shape.

Also in the above structure, the weight of the lock plate 31 can be reduced, and, in the same manner as the first embodiment, fuel economy can be improved. In addition, by forming the other side, where a large force relatively hardly acts on, of the lock plate 31, into the hollow shape like the present embodiment, there is a merit that the weight of the lock plate 31 can be reduced without sacrificing durability.

Figure 11:
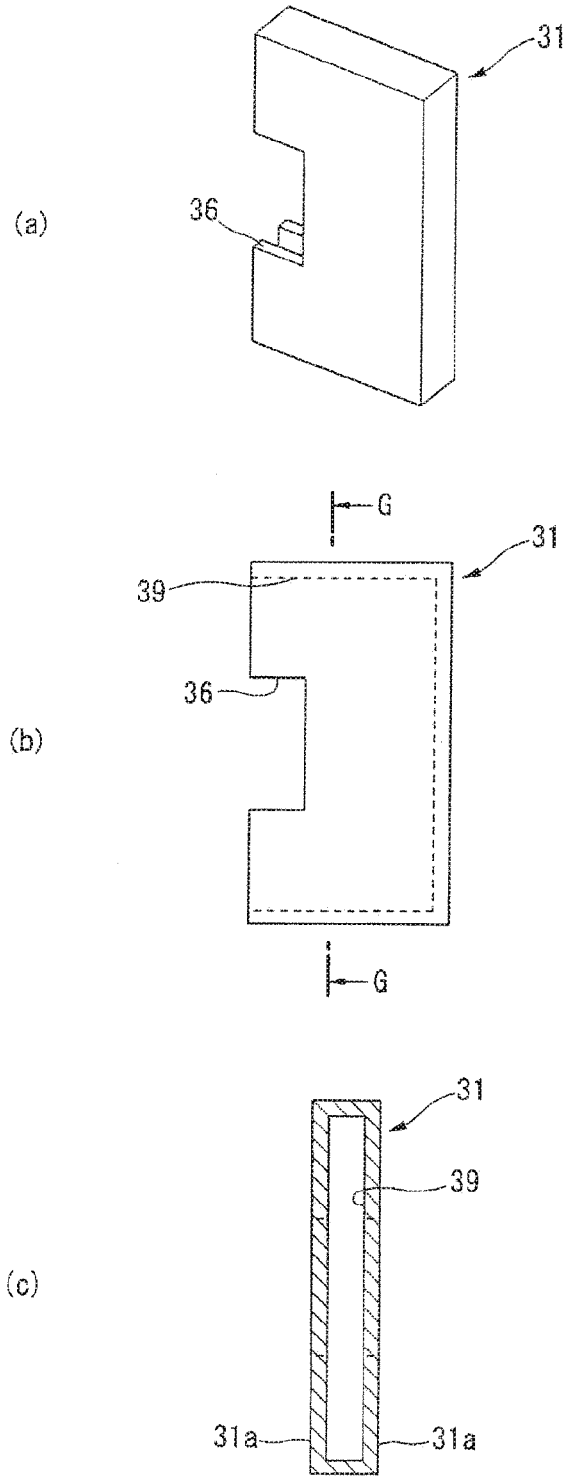
FIG. 11 (*a*) to FIG. 11 (*c*) show another modification example of the lock member according to the third embodiment of the present invention.

Further, as shown in FIG. 11, in a case where the whole of the lock plate 31 is formed into the hollow shape, further weight reduction can be possible, thereby further improving fuel economy.

The present invention is not limited to the configuration of each of the embodiments. For example, various modifications of not only specific structures, such as the housing 10, the vane rotor 20 and the oil pressure supply-exhaust unit 4, which do not directly relate to features of the present invention, but also specific modes of the lightening portions and the multilayer structure which directly relate to the features of the present invention, could be employed as long as the above-mentioned working effects of the present invention can be obtained. And these can be freely changed depending on modifications of an internal combustion engine to which the present invention applies.

In the following, technical ideas which are not disclosed in scope of claims and can be understood from the embodiments described above are explained.

(a) In the valve timing control device for the internal combustion engine according to claim 3,
a plurality of penetrating holes are provided.

In a case of the above structure, not only further weight reduction but also storage of more oil in the penetrating holes can be possible. Thus, further good lubrication effect can be obtained.

(b) In the valve timing control device for the internal combustion engine described in (a),
the penetrating hole is formed by a substantially circular hole.

(c) In the valve timing control device for the internal combustion engine described in (a),
the penetrating hole is formed by a substantially polygonal hole.

(d) In the valve timing control device for the internal combustion engine according to claim 5 or 6,
a plurality of concave portions are provided.

(e) In the valve timing control device for the internal combustion engine according to claim 9,
a lightening portion is provided at the low specific gravity material.

(f) In the valve timing control device for the internal combustion engine described in (e),
the lightening portion is formed by a penetrating hole.

(g) In the valve timing control device for the internal combustion engine described in (f),
the lightening portion is formed by a concave portion.

(h) In the valve timing control device for the internal combustion engine according to claim 9,
the low specific gravity material is made of an aluminum based metal material, and the high hardness material is made of an iron based metal material.

(i) In the valve timing control device for the internal combustion engine according to claim 7,
the lock member is made of two or more kinds of materials whose specific gravity and hardness are different from each other, and the low specific gravity material is coated with a layer made of the high hardness material.

EXPLANATION OF SIGNS

10: housing (driving rotation body)
20: vane rotor (driven rotation body)
31: lock plate (lock member)
32: engagement groove
33: spring (biasing member)
34: release unit

The invention claimed is:

1. A valve timing control device for an internal combustion engine, comprising:

a driving rotation body to which rotation force is transmitted from a crankshaft;

a driven rotation body accommodated in the driving rotation body and rotatably provided relative to the driving rotation body within a predetermined angle range;

a lock member having a plate shape and provided so as to move forward and backward along a radial direction from one side of the driving rotation body and the driven rotation body to the other side of the driving rotation body and the driven rotation body;

an engagement groove with which a tip end side of the lock member is engaged when a relative phase of the driven rotation body with respect to the driving rotation body becomes a predetermined phase;

a biasing member which biases the lock member to an engagement groove side; and a release unit which releases engagement of the lock member to the engagement groove by supplying oil pressure to a pressure-receiving portion provided at the tip end side of the lock member, wherein a lightening portion is provided at a part except an edge portion on a sliding contact surface, which corresponds to a circumferential direction side of the driving rotation body, of the lock member.

2. The valve timing control device for the internal combustion engine according to claim 1, wherein the lightening portion is formed by a penetrating hole.

3. The valve timing control device for the internal combustion engine according to claim 2, wherein a plurality of penetrating holes are provided.

4. The valve timing control device for the internal combustion engine according to claim 3, wherein each of the penetrating holes is formed by a substantially circular hole.

5. The valve timing control device for the internal combustion engine according to claim 3, wherein each of the penetrating holes is formed by a substantially polygonal hole.

6. The valve timing control device for the internal combustion engine according to claim 1, wherein the lightening portion is formed by a concave portion.

7. The valve timing control device for the internal combustion engine according to claim 6, wherein the concave portion is provided on both of a pair of sliding contact surfaces.

8. The valve timing control device for the internal combustion engine according to claim 7, wherein a plurality of concave portions are provided.

9. The valve timing control device for the internal combustion engine according to claim 6, wherein the concave portion is provided on one of a pair of sliding contact surfaces.

10. A valve timing control device for an internal combustion engine, comprising:

a driving rotation body to which rotation force is transmitted from a crankshaft;

a driven rotation body accommodated in the driving rotation body and rotatably provided relative to the driving rotation body within a predetermined angle range;

a lock member having a plate shape and provided so as to move forward and backward along a radial direction from one side of the driving rotation body and the driven rotation body to the other side of the driving rotation body and the driven rotation body, the lock member formed by polymerizing metal materials which are different from each other;

an engagement groove with which a tip end side of the lock member is engaged when a relative phase of the driven rotation body with respect to the driving rotation body becomes a predetermined phase;

a biasing member which biases the lock member to an engagement groove side; and a release unit which releases engagement of the lock member to the engagement groove by supplying oil pressure to a pressure-receiving portion provided at the tip end side of the lock member.

11. The valve timing control device for the internal combustion engine according to claim 10, wherein the lock member is made of two or more kinds of materials whose specific gravity and hardness are different from each other, including a material having a lower specific gravity than another of the materials and a material having a higher hardness than another of the materials, and at least a part of the material having the lower specific gravity is covered with the material having the higher hardness.

12. The valve timing control device for the internal combustion engine according to claim 11, wherein the material having the higher hardness is provided on a sliding contact surface of the lock member which is in sliding-contact with the driving rotation body or the driven rotation body.

13. The valve timing control device for the internal combustion engine according to claim 12, wherein a lightening portion is provided at the material having the lower specific gravity.

14. The valve timing control device for the internal combustion engine according to claim 13, wherein the lightening portion is formed by a penetrating hole.

15. The valve timing control device for the internal combustion engine according to claim 14, wherein the lightening portion is formed by a concave portion.

16. The valve timing control device for the internal combustion engine according to claim 12, wherein the material having the lower specific gravity is made of an aluminum based metal material, and the material having the higher hardness is made of an iron based metal material.

17. The valve timing control device for the internal combustion engine according to claim 10, wherein the lock member is made of two or more kinds of materials whose specific gravity and hardness are different from each other, including a material having a lower specific gravity than another of the materials and a material having a higher hardness than another of the materials, and the material having the lower specific gravity is coated with a layer made of the material having the higher hardness.

18. A valve timing control device for an internal combustion engine, comprising:

a driving rotation body to which rotation force is transmitted from a crankshaft;

a driven rotation body accommodated in the driving rotation body and rotatably provided relative to the driving rotation body within a predetermined angle range;

a lock member having a plate shape and provided so as to move forward and backward along a radial direction from one side of the driving rotation body and the driven rotation body to the other side of the driving rotation body and the driven rotation body, the lock member having, at an inside thereof, a hollow;

an engagement groove with which a tip end side of the lock member is engaged when a relative phase of the driven rotation body with respect to the driving rotation body becomes a predetermined phase;

a biasing member which biases the lock member to an engagement groove side; and a release unit which releases engagement of the lock member to the engagement groove by supplying oil pressure to a pressure-receiving portion provided at the tip end side of the lock member.

* * * * *